United States Patent [19]

Barrett et al.

[11] 4,291,072

[45] Sep. 22, 1981

[54] METHOD OF PRODUCING AIR-PERMEABLE FABRIC CONDITIONER SHEET FOR LAUNDRY DRYER

[75] Inventors: John H. Barrett, La Mirada; Brian P. Flynn, Long Beach, both of Calif.

[73] Assignee: Purex Corporation, Lakewood, Calif.

[21] Appl. No.: 962,472

[22] Filed: Nov. 20, 1978

Related U.S. Application Data

[62] Division of Ser. No. 840,102, Oct. 6, 1977, abandoned.

[51] Int. Cl.[3] ..... B05D 5/00

[52] U.S. Cl. ..... 427/243; 118/63; 427/273

[58] Field of Search ..... 427/286, 273, 244, 348, 427/242, 243; 118/63

[56] References Cited

U.S. PATENT DOCUMENTS

| | | | |
|---|---|---|---|
| 1,328,541 | 1/1920 | Palmer | 427/348 |
| 3,155,540 | 11/1964 | Loeffler et al. | 427/286 X |
| 3,895,128 | 7/1975 | Gaiser | 427/242 X |
| 3,956,556 | 5/1976 | McQueary | 428/131 |

FOREIGN PATENT DOCUMENTS

| | | | |
|---|---|---|---|
| 791618 | 3/1958 | United Kingdom | 427/348 |

*Primary Examiner*—Evan K. Lawrence
*Attorney, Agent, or Firm*—William W. Haefliger

[57] ABSTRACT

A fabric conditioner composition is applied to an air-permeable sheet and variably displaced so that the conditioner occludes interior interstitial spaces in certain regions of the sheet to block air flow therethrough, leaving other regions of the sheet with interstitially open spaces.

13 Claims, 7 Drawing Figures

FIG. 4.
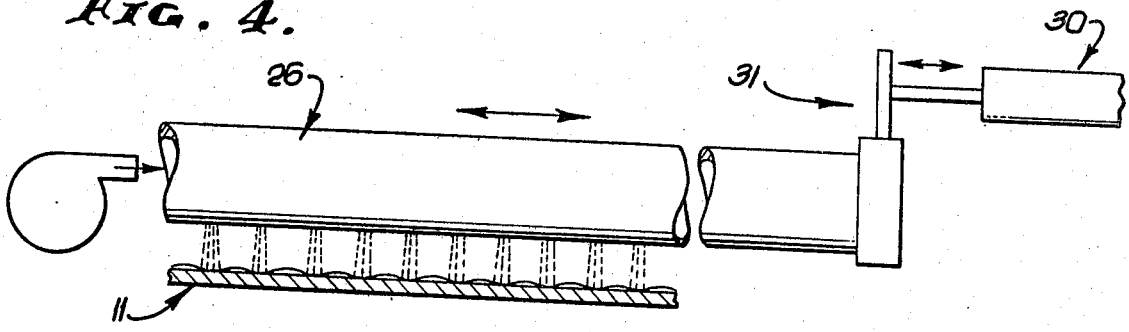
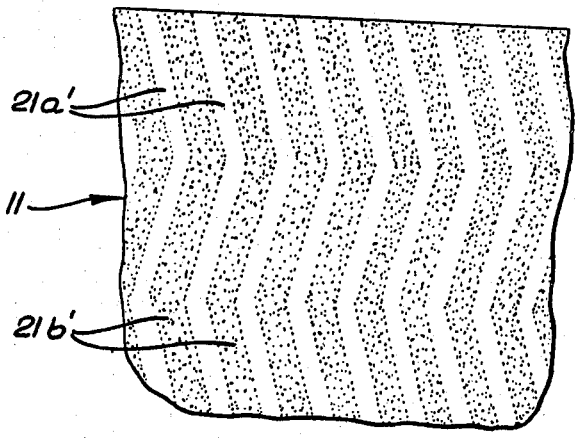
FIG. 5.

METHOD OF PRODUCING AIR-PERMEABLE FABRIC CONDITIONER SHEET FOR LAUNDRY DRYER

This is a division of application Ser. No. 840,102, filed Oct. 6, 1977, abandoned.

BACKGROUND OF THE INVENTION

This invention relates generally to the production of fabric conditioners, and more particularly concerns the application of such conditioners to air permeable sheets.

In the past, fabric conditioning sheets configured to tumble in a home laundry or commercial dryer oftentimes undesirably restricted air flow through the dryer, inhibiting drying and extending the drying cycle with consequent energy wastage. This came about because the sheets could partially or totally cover the dryer exhaust outlet port as during tumbling to cause the conditioning agent to leave the sheet and deposit on fabrics. The problem became exacerbated with the use of larger size sheets, for example of 9 by 11 inch size. Attempts to solve the problems included slitting or perforating the sheets; however, certain problems remained, because slit sheets still tend to restrict air flow; and perforated sheets could carry less conditioning composition than unperforated sheets, and they also undesirably restricted air flow at the rather small size orifices formed by the perforations.

SUMMARY OF THE INVENTION

It is a major object of the invention to provide a method of producing a fabric conditioner usable in a laundry dryer, and which overcomes the problems as referred to above.

Basically, the new method includes applying a fabric conditioner composition to an air-permeable sheet, and variably displacing the applied composition (as for example by projecting gas jets against the sheet). As will appear, the method provides substantially regularly distributed composition concentrations impregnating and occluding interior interstitial spaces in certain regions of the sheet interior to block airflow therethrough, and greater air permeability at other sheet interior regions located adjacent to and between said concentrations than at said concentrations, such other regions of the sheet characterized by interstitially open spaces including relatively larger spaces from which conditioner composition has been removed by said gas jets, and relatively smaller spaces which contain remanent conditioner composition. Typically, gas jets are projected in spaced relation corresponding to the relative spacing of the other interior regions of the sheet, and producing spaced stripe like courses on the sheet.

More specifically, typical steps of the method may include:

(a) passing the sheet through a liquid bath of a fabric conditioner composition in a solvent, thereby to impregnate the sheet with said composition, (b) removing excess composition from the sheet, (c) passing the impregnated sheet through a heating zone to remove said solvent, whereby essentially only dried conditioner composition remains on the sheet, (d) directing gas jets at the traveling sheet to blow conditioner composition from predetermined zones of the sheet and to form spaced stripe-like courses of dried conditioner composition remanent on the sheet, the jets being so directed in spaced apart relation corresponding to the spacing of said courses, and (e) cooling the sheet, for subsequent sizing As a result, high quality product may be rapidly produced, the sheets remaining highly air-permeable even though they may carry an amount of softener composition or agent about the same as normally applied uniformly over the surface of a perforated or unperforated sheet. See for example the disclosure in U.S. Pat. No. 3,895,128 to Gaiser.

These and other objects and advantages of the invention, as well as the details of illustrative embodiments, will be more fully understood from the following description and drawings, in which:

BRIEF DESCRIPTION OF THE DRAWING

FIG. 4 is a view like FIG. 2, but showing apparatus to produce zig-zag fabric softener concentrations on the carrier sheet;

FIG. 5 is a plan view of a carrier sheet coated with zig-zag fabric softener concentrations;

DETAILED DESCRIPTION

Figure 1:
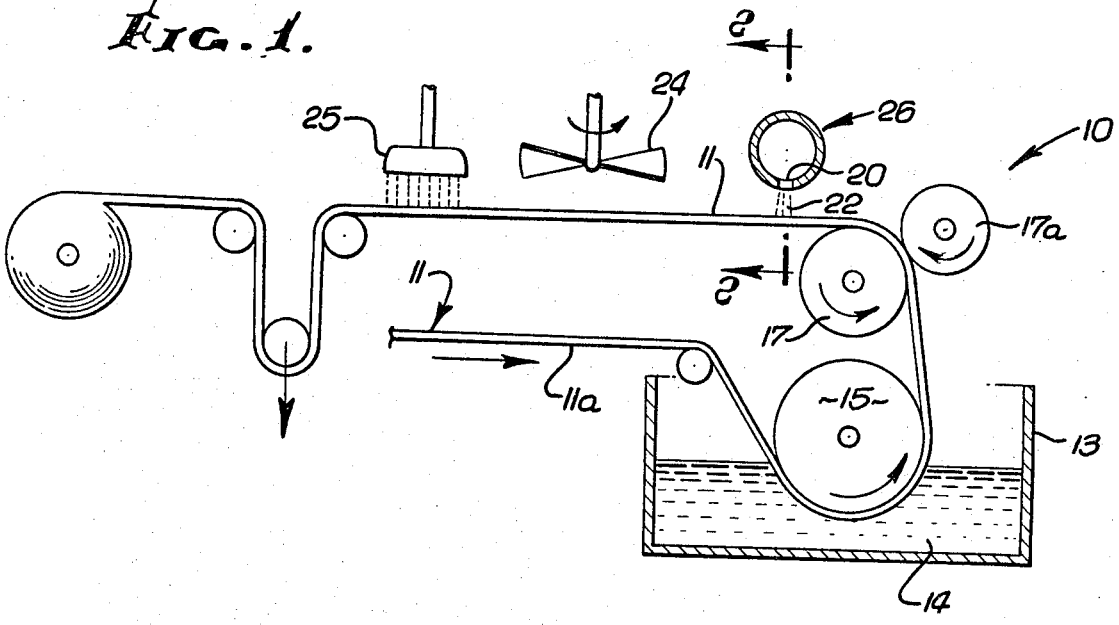
FIG. 1 is a side elevation view of apparatus usable to carry out the invention.
Figure 2:
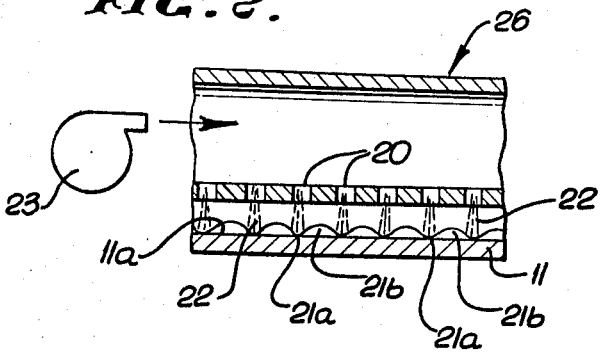
FIG. 2 is an enlarged section, in elevation, on lines 2—2 of FIG. 1.

Referring to FIGS. 1 and 2, apparatus is shown at 10 for producing a fabric conditioner, which employs an air permeable sheet 11. In general the apparatus includes means for effecting differential distribution of fabric conditioner onto the sheet as the sheet travels relatively past the apparatus, one example of such conditioner being fabric softener. Such means may include structure to first substantially uniformly coat at least one of the sheet surfaces 11*a*, or to impregnate the sheet, with the composition as the sheet travels lengthwise. For example, a receptacle 13 may contain liquid form coating composition 14 which transfers onto the sheet as it passes under roller 15. The latter is rotated in response to lengthwise travel of the sheet 11. As the sheet emerges from the bath 14, it passes through the nip between padding rolls 17 and 17*a*. The sheet may be trained about roller 17 so as to travel reversely with coated surface 11*a* upwardly presented as the sheet leaves roll 17 and travels to the left.

Figure 2A:
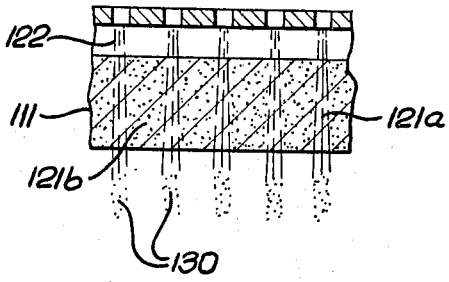
FIG. 2*a* is an enlarged section showing fabric differentially impregnated in accordance with the invention.

The means to effect differential distributions of fabric conditioner, such as softening composition onto the sheet also typically includes distributors facing the sheet for forming predetermined localized concentrations of the composition on the sheet, leaving it with greater permeability between the concentrations than at or directly under the concentrations. As shown in FIG. 2, such distributors comprise gas or air jet orifices 20 spaced apart transversely of the sheet 11 to project gas jets toward the sheet for displacing the conditioner, in wet or damp state, from the jet paths 22. This is exemplified in FIG. 2 by thinning or elimination of the composition coating at loci 21*a* directly under the jets, so as to leave the sheet relatively air permeable at such loci 21*a* and thickening of the coating at loci 21*b* laterally of said paths. FIG. 2*a* shows an air permeable sheet 111 characterized as having a network of fibers forming interstitial spaces therebetween. The conditioner impregnates the sheet to loosely coat the fibers at regions 121*b*; and the gas jets 122 blow through the sheet with sufficient force to remove the conditioner composition in divided particle form at 130, at opened pore regions 121*a*. Region 121*a* and 121*b* correspond to regions 21*a* and 21*b*.

Figure 3:
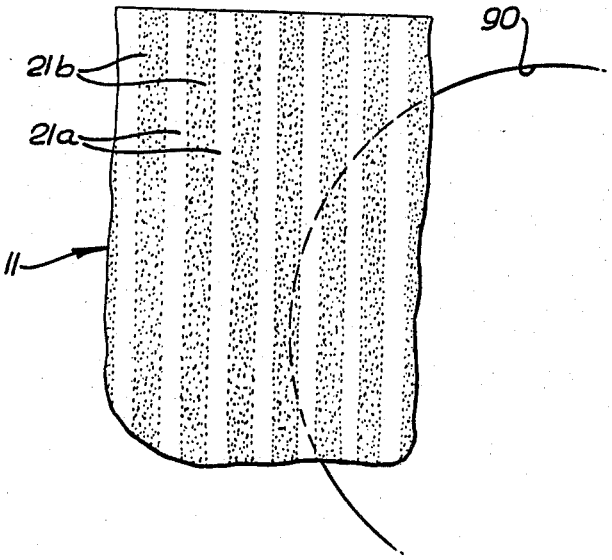
FIG. 3 is a plan view of a fragment of carrier sheet coated with fabric softener, in accordance with the invention.

The resultant sheet appears as in FIG. 3, with linearly extending loci 21*a* and 21*b*. It is found that the loci 21*a* of lesser or no coating or impregnation allow sufficient air to pass through the air-permeable sheet, should it for example be brought into partial or total covering relation with the hot damp air exhaust vent 90 in the dryer, so as not to undesirably restrict drying.

The air orifices 20 may be provided by perforating the wall of a pipe 26, say of ½ inch diameter, to which air is supplied under pressure by a blower 23. The orifices are preferably about 1/16 inch in diameter, and their centers are spaced about 1/6 inch apart. The air pressure supplied to the pipe is about 10 to 100 psi, i.e. to produce desired air permeability without rupturing the sheet material.

In a typical example, the sheet consisted of non-woven rayon substrate passed through a bath 14 of molten cationic fabric softener-isopropanol mixture and then through the nip between padder rolls 17 and 17*a*. For example, the bath consisted of 75% by weight of dimethyl di-tallow quaternary ammonium methyl sulfate, and 25% by weight of isopropanol solvent. Other additives such as perfume may be employed. After tretment by the jets 22, the sheet passed hot air fans 24 and infra red heat lamps 25.

The impregnated, dried product was cut into 9 by 11 inch sheets and tested for air permeability by positioning the sheet over the exhaust duct outlet from a Kenmore Model 96690100 household clothes dryer fitted with a Velometer at its exhaust duct to measure air velocity in feet/minute.

A sheet which was not treated by the jets 22 in accordance with the invention caused a 42% reduction in air flow velocity at the exhaust outlet. A sheet treated in accordance with the invention caused only 15% to 18% reduction in air flow velocity, where the jet orifice diameters were 1/16 inch and the orifices were spaced apart about 1/16 inch. It was further found that a sheet treated with air jets having 1/16 inch diameter orifices spaced apart ¼ inch produce a 31% reduction in dryer air outlet velocity. Using 1/16 inch air jet orifices spaced 1/6 inch apart, the lightly impregnated or coated loci 21*a* are about 1/12 inch wide.

The air permeable substrate or sheet may consist for example of non-woven or woven rayon or polyester, viscose, nylon, polyacrylonitrile, polyolefin, cellulose such as wet strength paper, or polyurethane. The sheet porosity is such that before treatment it has a fiber concentration allowing at least about 90% air passage therethrough, in a dryer. Microscopic examination of the finished product shows that the heavily impregnated areas have interstitial substrate spaces completely occluded with fabric conditioning agent, or softener, and the lightly impregnated areas 21*a* have larger interstitial substrate spaces completely free of the agent, although it may coat and fill smaller interstitial spaces. The conditioning agent may consist of any of the agents described, for example in U.S. Pat. No. 3,895,128 to Gaiser, and in U.S. Pat. No. 3,686,025 to Morton. Other agents may be employed, such as those to produce anti-static, anti-mildew, germicidal, moth proofing anti-wrinkling, and perfuming functions.

FIG. 4 shows the provisions of additional means effecting relatively transverse back and forth movement of the duct 26 and orifices 20. One such means includes an actuator 30 coupled at 31 to the duct 22. The resultant striping on the sheet 11 appears in FIG. 5, with alternate zig-zag or simuous occluded zones 21*b*′ and zig-zag or sinuous air permeable zones 21*a*′.

Figure 6:
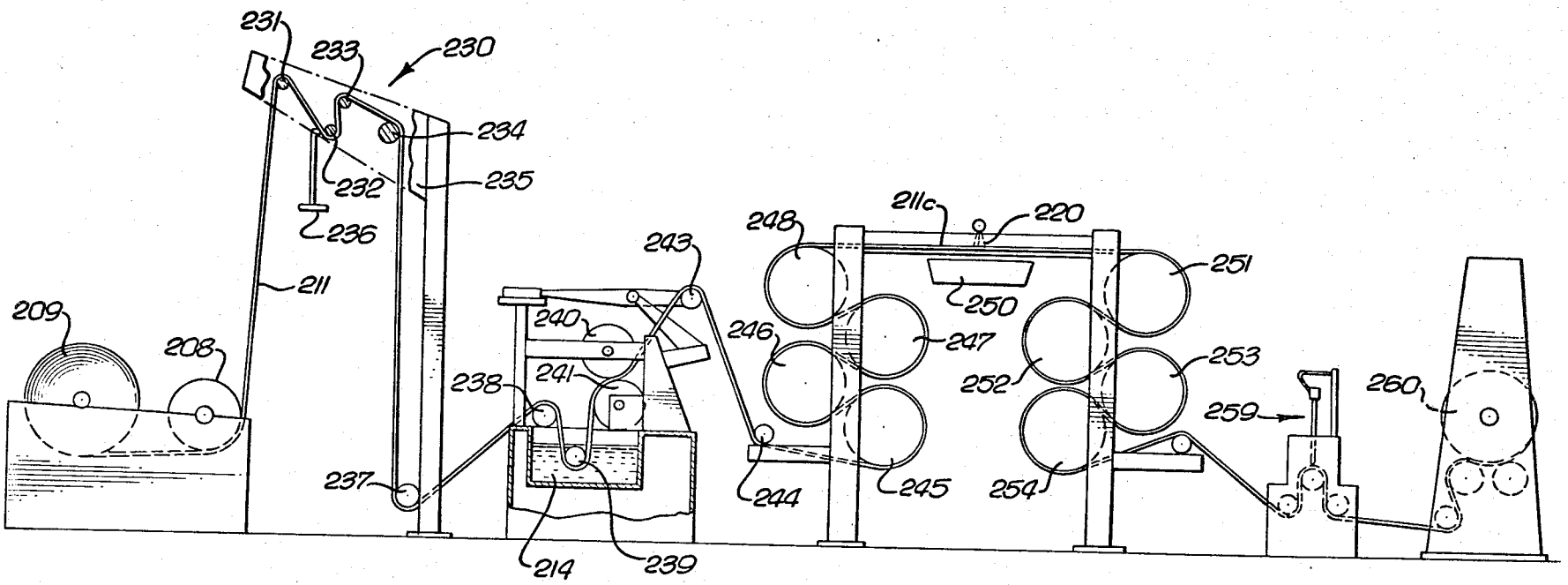
FIG. 6 is a side elevation showing other features of apparatus to produce the product.

In FIG. 6, the sheet strip 211 (corresponding to sheet 11 in FIGS. 1–3) unwinds off a supply roll 209, turns about roller 208, and passes through tensioner means indicated at 230. The latter includes rollers 231, 233 and 234 supported by frame 235, as indicated. Roller 232 is controlled by handle 236 to control tension of the sheet strip.

After turning about lower roller 237, and roller 238, the sheet strip enters the conditioning agent bath 214 corresponding to bath 14 in FIG. 1. The sheet strip passes about roller 239 and emerges from the bath coated on both sides, or impregnated. It then passes through the nip between padding rollers 240 and 241, becoming further interstitially impregnated with the conditioning agent (for example fabric softener). Also, the rollers 240 and 241 remove excess agent from the sheet surfaces.

The sheet is then subjected to heating to temperatures between about 150° F. and 300° F. to drive off the solvent in the conditioner. For example, and strip is turned by rollers 243 and 244 to pass back and forth between and over heating drums 245–248. The conditioning agent is then in divided state, coating the fibers of the sheet. As the sheet strip passes horizontally at 211*c*, it is subjected to gas jet treatment at 220, in the same manner as described in FIG. 1 and FIG. 2*a*. Such treatment blows the conditioning agent out of certain interstitial zones of the sheet correponding to spaced zones 121*a* in FIG. 2*a*, the removed agent being collected in pan 250.

Thereafter, the sheet strip passes back and forth between and over cooling drums 251–254, where it is cooled to ambient temperature effecting setting or solidifying of the conditioning agent bands or strips left in the sheet. This assures that such bands will not subsequently be pushed or displaced into the adjacent and alternating air permeable bands or stripes, as described, upon subsequent mechanical treatment such as during slitting at 259 and winding on roll 260. Such slitting cuts the sheet strip into desired widths for laundry use.

We claim:

1. The method of producing a fabric conditioner to be used in a laundry dryer, that includes (a) treating an air permeable sheet, including distributing a fabric conditioner composition on the surface of said sheet, (b) said treating including variably displacing said distributed composition on the sheet by application of displacing media thereto thereby providing substantially regularly distributed composition concentrations occluding interior interstitial spaces at certain regions of the sheet interior to block airflow therethrough, and greater air permeability at other sheet interior regions located adjacent to and between said concentrations than at said concentrations, said other regions of the sheet characterized by interstitially open spaces including relatively larger spaces from which conditioner composition has been removed by said variable displacement step, and relatively smaller spaces at which conditioner composition remains.

2. The method of producing a fabric conditioner usable in a laundry dryer that includes applying a fabric conditioner composition to an air-permeable sheet, and projecting gas jets against the sheet variably displacing the applied composition from the paths of the gas jets thereby providing substantially regularly distributed composition concentrations impregnating and occluding interior interstitial spaces in certain regions of the sheet interior to block airflow therethrough, and greater air permeability at other sheet interior regions located adjacent to and between said concentrations than at said concentrations, said other regions of the sheet characterized by interstitially open spaces including relatively larger spaces from which conditioner composition has been removed by said gas jets, and relatively smaller spaces which contain remanent conditioner composition, said jets being projected in spaced relation corresponding to the relative spacing of said other interior regions of the sheet.

3. The method of claim 2 in which said applied fabric conditioner as applied to the sheet is moist.

4. The method of claim 2 in which gas streams are projected through sheet interstitial spaces in a predetermined pattern.

5. The method of claim 2 wherein each jet is projected to have about 1/16 inch in overall cross sectional dimension.

6. The method of claim 2 wherein said jets are projected to have centers with about 1/6 inch spacing.

7. The method of claim 2 wherein said sheet consists of fabric selected from the group consisting of rayon, polyester, nylon, polyacrylonitrile, polyolefin, cellulose, and polyurethane.

8. The method of claim 2 wherein said composition consists of a fabric softener.

9. The method of producing a fabric conditioner usable in a laundry dryer that includes applying a fabric conditioner composition to an air permeable sheet, projecting gas jets against the sheet and displacing the fabric conditioner composition from the paths of the gas jets and in spaced stripe-like courses on the sheet defining relatively thick and thin concentrations of conditioner composition, the jets being projected in spaced relation corresponding to the spacing of said courses.

10. The method of claim 9 wherein said displacement is carried out so that said courses are formed with about 1/12 inch widths.

11. The method of claim 9 including drying the sheet and fabric conditioner composition courses.

12. The method of claim 9 including heating the sheet and conditioner composition before said displacement step, and cooling the sheet and said conditioner composition courses after said displacing step.

13. The method of producing a fabric conditioner to be employed in a laundry dryer, and using an air permeable sheet that includes (a) passing the sheet through a liquid bath of a fabric conditioner composition in a solvent, thereby to impregnate the sheet with said composition, (b) removing excess composition from the sheet, (c) passing the impregnated sheet through a heating zone to remove said solvent, whereby essentially only dried conditioner composition remains on the sheet, (d) directing gas jets at the traveling sheet to blow conditioner composition from predetermined zones of the sheet and to form spaced stripe-like courses of dried conditioner composition remanent on the sheet, the jets being so directed in spaced apart relation corresponding to the spacing of said courses, and (e) cooling the sheet, for subsequent sizing.

* * * * *